US006423916B1

(12) United States Patent
Koebrick

(10) Patent No.: US 6,423,916 B1
(45) Date of Patent: Jul. 23, 2002

(54) COMBINATION SWITCH AND UNIVERSAL MOUNTING BRACKET AND METHOD OF USE

(76) Inventor: Arthur W. Koebrick, 69395 El Canto Rd., Cathedral City, CA (US) 92234

( * ) Notice: Subject to any disclaimer, the term of this patent is extended or adjusted under 35 U.S.C. 154(b) by 88 days.

(21) Appl. No.: 09/615,361

(22) Filed: Jul. 13, 2000

(51) Int. Cl.[7] ..... H01H 9/02; G12B 9/00
(52) U.S. Cl. ..... 200/293; 200/294; 248/27.1
(58) Field of Search ..... 200/293–296; 248/27.1–27.3; 361/600–837; 174/1–66

(56) References Cited

U.S. PATENT DOCUMENTS 4,128,745 A 12/1978 Marsilio et al.
4,152,578 A 5/1979 Jacobs
4,192,399 A * 3/1980 Otteson et al. ..... 200/61.86 X
4,200,774 A * 4/1980 Nelms ..... 200/44
4,922,225 A * 5/1990 Dankert ..... 200/538
D345,415 S 3/1994 Bremer
5,791,456 A * 8/1998 Schaefer ..... 200/293

* cited by examiner

*Primary Examiner*—J. R. Scott
(74) *Attorney, Agent, or Firm*—Eric Karich

(57) ABSTRACT

A combination switch and universal mounting bracket has a switch and a universal mounting bracket. The switch includes a switch housing having a face, four sidewalls, and a rear. The universal mounting bracket includes a mounting base plate having a housing aperture shaped to slidably engage the switch housing. Three mounting arms are pivotally attached to a mounting side of the mounting base plate, each of the three mounting arms having a mounting aperture on a terminal end for mounting the universal mounting bracket onto a mounting surface with a screw. A base end of each of the three mounting arms is pivotally attached to the mounting base plate such that each of the three mounting arms pivots between a first position in which the mounting arm is generally orthogonal to the mounting base plate, to a second position in which the mounting arm is generally on the same plane as the mounting base plate.

6 Claims, 2 Drawing Sheets

COMBINATION SWITCH AND UNIVERSAL MOUNTING BRACKET AND METHOD OF USE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to switches, and more particularly to a combination switch and universal mounting bracket that allows switches to be easily installed in places that were otherwise not possible.

2. Description of Related Art

Switches, such as disclosed in Marsilio, et al., U.S. Pat. No. 4,128,745, are used to enable a user to control the flow of power to an electronic device. It is highly desirable to mount an appropriate switch in close proximity to the electronic device to make it easy for the user to find and use the switch.

There are many instances, however, in which it is difficult to mount the switch close to the electronic device. In particular, it is desirable but difficult to mount a switch close to a resistive water heater element, such as is shown in Bremer, U.S. Des. 345,415. In this instance, the resistive water heater element is installed in a drain hole of a water tank of a motor home or similar recreational vehicle. There is simply no suitable location to mount a switch using a prior art switch mounting plate.

The prior art teaches a switch mounting plate for mounting a switch. However, the prior art does not teach a universal mounting bracket useful for mounting a switch in close proximity to the water tank of a motor home. The present invention fulfills these needs and provides further related advantages as described in the following summary.

SUMMARY OF THE INVENTION

The present invention teaches certain benefits in construction and use which give rise to the objectives described below.

The present invention provides a combination switch and universal mounting bracket for use in mounting a switch, using a universal mounting bracket, in locations where it would otherwise be difficult to install the switch, such as adjacent a water tank in a motor home or other recreational vehicle. The switch includes a switch housing having a face, four sidewalls, and a rear. The universal mounting bracket includes a mounting base plate having a housing aperture shaped to slidably engage the switch housing, but not allow the face of the switch housing to pass therethrough. At least two mounting arms are pivotally attached to a mounting side of the mounting base plate, each of the at least two mounting arms having a base end and a terminal end. The base end of each of the at least two mounting arms is pivotally attached to the mounting base plate such that each of the at least two mounting arms pivots between a first position in which the mounting arm is generally orthogonal to the mounting base plate, to a second position in which the mounting arm is generally on the same plane as the mounting base plate. A mounting aperture is located through the terminal end of each of the at least two mounting arms, thereby allowing the universal mounting bracket to be attached to a mounting hole in a mounting surface with a screw.

A primary objective of the present invention is to provide a combination switch and universal mounting bracket having advantages not taught by the prior art.

Another objective is to provide a universal mounting bracket that allows the installation of a switch on a mounting surface where it would otherwise be difficult to install the switch, such as adjacent a water tank of a motor home or other recreational vehicle.

A further objective is to enable the installation of the switch without requiring any holes to be drilled into the mounting surface.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
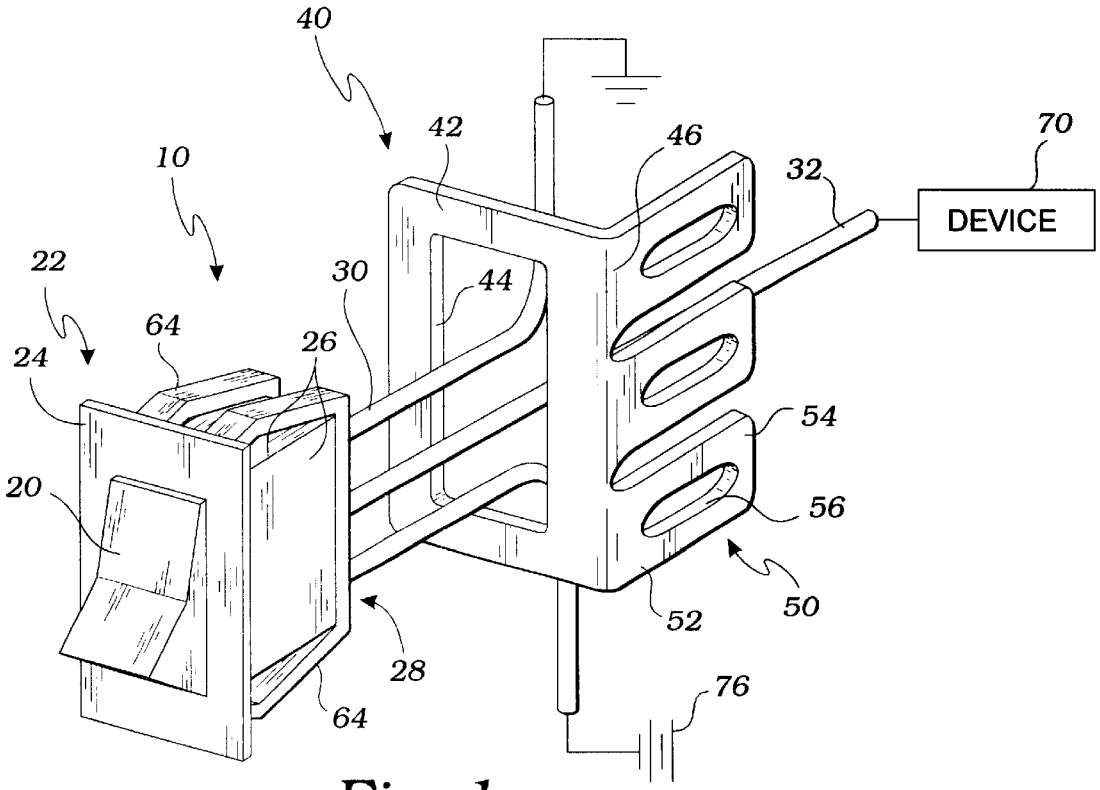
FIG. 1 is an exploded perspective view of the preferred embodiment of the present invention.

The above described drawing figures illustrate the invention, a combination switch and universal mounting bracket 10 for use in mounting a switch 20 using a universal mounting bracket 40. The universal mounting bracket 40 makes it possible to install the switch 20 in locations where it would otherwise be difficult to install the switch 20. The combination 10 is preferably used to enable the installation of the switch 20 in proximity to a resistive heating element 70 adjacent a water tank 72 of a motor home or other recreational vehicle, as described below.

As shown in FIG. 1, the switch 20 includes a switch housing 22 having a face 24, four sidewalls 26, and a rear 28. A power electrical contact 30 and a device electrical contact 32 are positioned at the rear 28 of the switch housing 22. The switch 20 is pivotally mounted in the face 24 of the switch housing 22. The switch 20 pivots between an on position in which the power and device electrical contacts 30 and 32 are electronically connected, and an off position in which the power and device electrical contacts 30 and 32 are not electronically connected. Such a switch is well known in the prior art; and such a switch is described in Marsilio, et al., U.S. Pat. No. 4,128,745, hereby incorporated by reference. While the switch 20 described is the preferred embodiment, alternative embodiments are generally known and available, including round switch housings. These alternative switches and alternative switch housings are expressly considered equivalent to the preferred embodiment described herein.

Figure 2:
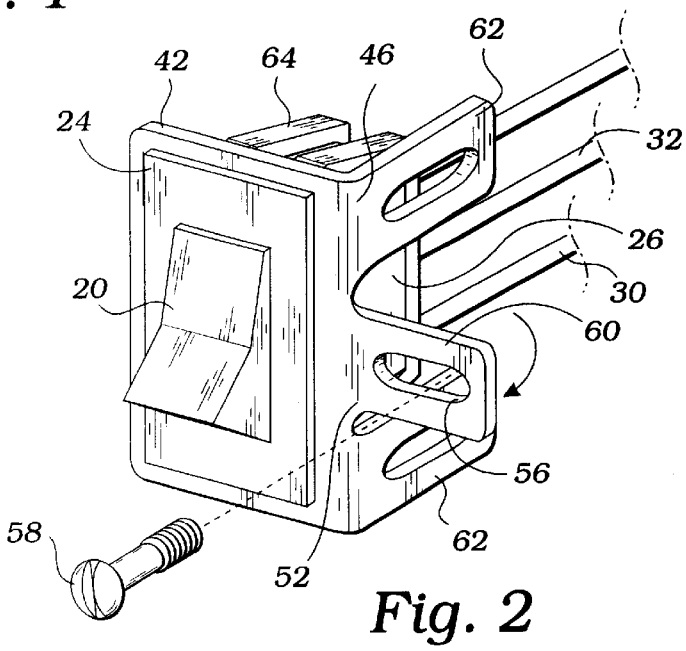
FIG. 2 is a perspective view thereof showing one of three mounting arms being pivoted from a first to a second position.

As shown in FIGS. 1 and 2, the universal mounting bracket 40 is shaped to receive the switch housing 22. In the preferred embodiment, the universal mounting bracket 40 includes a mounting base plate 42 having a housing aperture 44 shaped to slidably engage the four sidewalls 26 of the switch housing 22, but not allow the face 24 of the switch housing 22 to pass therethrough. The universal mounting bracket 40 is preferably constructed of a ductile and bendable metal for purposes of both strength, durability, and ease of manufacture, as well as for other purposes discussed in more detail below. The purpose of the mounting base plate 42 is to provide a solid surface for mounting the switch housing 22. Obviously, alternative housing apertures that are equivalent to the presently described embodiment can be devised by those skilled in the art, the housing apertures being shaped to receive alternative switches that are equivalent to the switch 20 and switch housing 22 described above.

Figure 3:
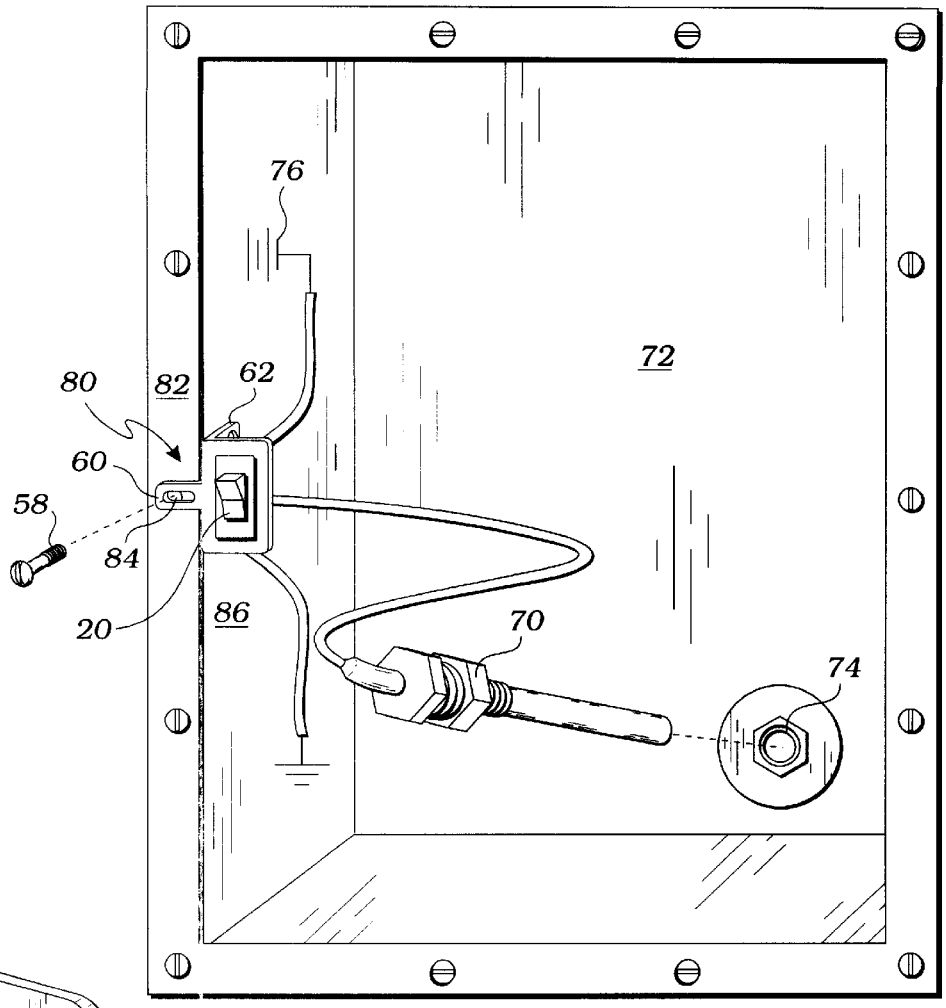
FIG. 3 is a perspective view of the invention installed on a mounting surface adjacent a water tank.

As shown in FIGS. 1–3, at least two mounting arms 50 are pivotally attached to a mounting side 46 of the mounting base plate 42. Each of the at least two mounting arms 50 has a base end 52 and a terminal end 54. The base end 52 of each of the at least two mounting arms 50 is pivotally attached to the mounting base plate 42 such that each of the at least two mounting arms 50 pivots between a first position in which the mounting arm is generally orthogonal to the mounting base plate 42, to a second position in which the mounting arm is generally on the same plane as the mounting base plate 42. A mounting aperture 56 is located through the terminal end 54 of each of the at least two mounting arms 50, thereby allowing the universal mounting bracket 40 to be attached to a mounting hole 84 with a screw 58, as described below.

The at least two mounting arms 50, and their pivotal engagement to the mounting base plate 42, are the critical component of the present invention. In the preferred embodiment, as shown in FIG. 1, the at least two mounting arms 50 include three mounting arms that extend parallel to each other and evenly spaced along the mounting side 46. The three mounting arms 50 are integral with the mounting base plate 42 and positioned in the first position, in which the three mounting arms 50 are orthogonal to the mounting base plate 42.

As shown in FIG. 2, the three mounting arms 50 can be pivoted from the first to the second position. In the preferred embodiment, the pivoting capability is provided by the natural bendable, ductile nature of the metal; however, other pivot mechanisms can be devised by those skilled in the art. In use, one 60 of the three mounting arms 50 is pivoted to the second position for attachment to a mounting surface 80, as described below. While we refer to bending the one 60 of the three mounting arms 50, there are some instances where two or possibly all three of the mounting arms 50 might be bent to the second position. Furthermore, while we discuss the first and second positions as being generally orthogonal to and generally within the same plane, respectively, as the mounting base plate 42, these angles are only provided as the preferred embodiment. An equivalent use of the combination 10 could include bending the mounting arms 50 to anywhere within a preferred range of 75 degrees to 270 degrees. The bending of the one 60 or more of the three mounting arms 50 is dictated by the structure of the mounting surface 80, as described in more detail below.

As shown in FIGS. 1 and 2, the switch housing 22 preferably further includes a means for locking 64 the switch housing 22 onto the universal mounting bracket 40. In its preferred embodiment, the means for locking 64 is a locking pivot arm for locking the switch housing 22 within the housing aperture 44. The locking pivot arm 64 extends from at least one of the four sidewalls 26 and pivots between an unlocked position in which the locking pivot arm 64 is approximately parallel to the one of the four sidewalls 26, and a locked position in which the locking pivot arm 64 extends from the at least one of the four sidewalls 26. The locking pivot arm 64 is biased towards the locked position, preferably by the natural resilient of the plastic material from the which locking pivot arm 64 is constructed. The locking pivot arm 64 preferably includes four locking pivot arms for forming a secure locking relationship with the universal mounting bracket 40.

Figure 4:
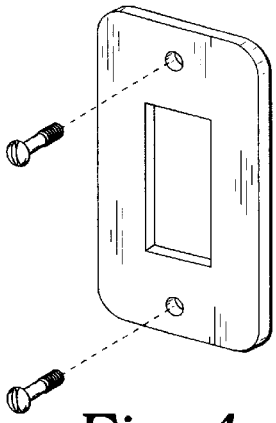
Fig. 4 Prior Art
FIG. 4 is a perspective view of a prior art mounting bracket.

The invention includes a method for using the above-described combination 10 to enable easy control of a device 70 such as a resistive water heater element. It is particularly desirable to use the combination 10 to enable easy control of the resistive water heater element 70 because the resistive water heater element 70 is preferably installed in drain hole 74 of a water tank 72 of a motor home or other form of recreational vehicle. Such an installation location is difficult to mount switches using prior art brackets, as shown in FIG. 4.

As shown in FIGS. 2 and 3, the switch housing 22 is first attached to the mounting base plate 42. In the preferred embodiment, the switch housing 22 is inserted into the housing aperture 44 until the face 24 of the switch housing 22 abuts the mounting base plate 42. During the insertion, the locking pivot arm 64 pivots from the locked position to the unlocked position as the switch housing 22 is pushed through the mounting aperture 56. The locking pivot arm 64 is shaped so that once the switch housing 22 abuts the mounting base plate 42, the locking pivot arm 64 is able to pivots to the locked position to lock the switch housing 22 within the housing aperture 44. Obviously, this is but one example of the means for locking 64 the switch housing 22 to the mounting base plate 42, and alternative embodiments that are equivalent to the given example should be considered within the scope of the present invention.

As shown in FIG. 3, the combination 10 is then attached to the mounting surface 80 adjacent to where the switch 20 is intended to be used. In the preferred embodiment, the mounting surface 80 is adjacent to the water tank 72 in the motor home. The mounting surface 80 in the present example includes a front surface 82 having a mounting hole 84 and a side surface 86 generally orthogonal to the front surface 82. The one 60 of the three mounting arms 50 is pivoted to the second position, as shown in FIG. 2, and the other two 62 of the three mounting arms 50 are pivoted to the first position. Thus configured, the mounting base plate 42 can be mounted adjacent the mounting surface 80 such that the one 60 of the three mounting arms 50 rests upon the front surface 82 with the mounting aperture 56 of the one 60 of the three mounting arms 50 positioned above the mounting hole 84 of the front surface 82, and such that the other two 62 of the three mounting arms 50 rest upon the side surface 86. The screw 58 is then driven through the mounting aperture 56 of the one 60 of the three mounting arms 50 and into the mounting hole 84 of the front surface 82, thereby securing the switch 20 to the mounting surface 80 adjacent the water tank 72. The three mounting arms 50 cooperate to provide a secure mount for the switch 20, allowing flush and secure installation of the switch 20.

As shown in FIG. 3, the combination 10 is preferably used in conjunction with the resistive water heater element 70 electronically connected to the device electrical contact 32. The resistive water heater element 70 is electronically connected to the device electrical contact 32 and the power source is electronically connected to the power electrical contact 30, and the resistive water heater element 70 is inserted into the drain hole 74 of the water tank 72, preferably threadedly engaging the drain hole 74 to prevent slippage or leakage. An example of an electric heating element is shown in Jacobs, U.S. Pat. No. 4,152,578, and an example of the use of an electronic heating element in the drain hole 74 of the water tank 72 of a motor home is shown in Bremer, U.S. Des. 345,415, both of which are hereby incorporated by reference.

While it is known in the prior art to install a resistive water heater element 70 into the drain hole 74 of the water tank 72 of a vehicle such as a motor home, there are not any mounting devices such as the combination 10 that can be used with such a device to enable easy control of the resistive water heater element 70. Prior art switch mounting plates, such as shown in FIG. 4, are not suitable for mounting a switch 20 near a water tank 72 in a motor home. This limitation has led, in the past, to water heating systems in which it is difficult to turn the resistive water heater element 70 on and off from a conveniently mounted switch located in proximity to the water tank 72.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination switch and universal mounting bracket, the combination comprising:

a switch mounted in a switch housing;

a universal mounting bracket having a mounting base plate and at least two mounting arms, the mounting base plate being shaped to receive the switch housing;

the at least two mounting arms being pivotally attached to a mounting side of the mounting base plate, each of the at least two mounting arms having a base end and a terminal end, the base end of each of the at least two mounting arms being pivotally attached to the mounting base plate such that each of the at least two mounting arms pivots between a first position in which the mounting arm is generally orthogonal to the mounting base plate, to a second position in which the mounting arm is generally on the same plane as the mounting base plate; and a mounting aperture through the terminal end of each of the at least two mounting arms.

2. The combination of claim 1 wherein the at least two mounting arms include three mounting arms are evenly spaced along the mounting side.

3. A combination switch and universal mounting bracket, the combination comprising:

a switch housing having a face, four sidewalls, and a rear;

a power electrical contact positioned at the rear of the switch housing;

a device electrical contact positioned at the rear of the switch housing;

a switch pivotally mounted in the face of the switch housing, the switch pivoting between an on position in which the power and device electrical contacts are electronically connected, and an off position in which the power and device electrical contacts are not electronically connected;

a universal mounting bracket having a mounting base plate and at least two mounting arms, the mounting base plate having a housing aperture shaped to slidably engage the four sidewalls of the switch housing, but not allow the face of the switch housing to pass therethrough;

a locking pivot arm for locking the switch housing within the housing aperture, the locking pivot arm extending from one of the four sidewalls and pivoting between an unlocked position in which the locking pivot arm is approximately parallel to the one of the four sidewalls, and a locked position in which the locking pivot arm extends from the one of the four sidewalls to lock the switch housing within the housing aperture of the mounting base plate, the locking pivot arm being biased towards the locked position;

each of the at least two mounting arms having a base end and a terminal end, the base end of each of the at least two mounting arms being pivotally attached to a mounting side of the mounting base plate such that each of the at least two mounting arms pivots between a first position in which the mounting arm is generally orthogonal to the mounting base plate, to a second position in which the mounting arm is generally on the same plane as the mounting base plate; and a mounting aperture through the terminal end of each of the at least two mounting arms.

4. The combination of claim 3 further comprising a resistive water heater element electronically connected to the device electrical contact.

5. The combination of claim 3 wherein the at least two mounting arms include three mounting arms that are evenly spaced along the mounting side.

6. A method for operably installing a resistive water heater element in drain hole of a water tank, the water tank being located adjacent a mounting surface and in proximity to a power source, the mounting surface having a front surface having a mounting hole and a side surface generally orthogonal to the front surface, the method comprising the steps of:

a) providing a switch housing having a face, four sidewalls, and a rear, the rear having a power electrical contact and a device electrical contact, the face having a switch pivotally mounted therein, the switch pivoting between an on position in which the power and device electrical contacts are electronically connected, and an off position in which the power and device electrical contacts are not electronically connected;

b) providing a universal mounting bracket having a mounting base plate and three mounting arms, the mounting base place having a mounting side and a housing aperture, the housing aperture being shaped to slidably engage the four sidewalls of the switch housing, the three mounting arms being pivotally attached to the mounting side of the mounting base plate, each of the three mounting arms having a base end and a terminal end, the base end of each of the three mounting arms being pivotally attached to the mounting side of the mounting base plate such that the mounting arm pivots between a first position in which the mounting arm is generally orthogonal to the mounting base plate, to a second position in which the mounting arm is generally on the same plane as the mounting base plate, each of the three mounting arms having a mounting aperture through the terminal end, and further including a screw shaped to fit the mounting aperture;

c) mounting the switch housing onto the mounting base plate;

d) pivoting one of the three mounting arms to the second position;

e) pivoting the other two of the three mounting arms to the first position;

f) positioning the mounting base plate adjacent a mounting surface such that the one of the three mounting arms rests upon the front surface with the mounting aperture of the one of the three mounting arms positioned above the mounting hole of the front surface, and such that the other two of the three mounting arms rest upon the side surface;

g) driving the screw through the mounting aperture of the one of the three mounting arms and into the mounting hole of the front surface, thereby securing the switch to the mounting surface adjacent the water tank;

h) electronically connecting the resistive water heater element to the device electrical contact;

i) electronically connecting the power source to the power electrical contact; and j) inserting the resistive water heater element into the drain hole of the water tank.

* * * * *